United States Patent [19]

Libman et al.

[11] Patent Number: 4,891,110

[45] Date of Patent: Jan. 2, 1990

[54] CATAPHORETIC PROCESS FOR SCREENING COLOR CATHODE RAY TUBES

[75] Inventors: Philomena C. Libman, Mt. Prospect; Charles J. Prazak, III, Elmhurst, both of Ill.

[73] Assignee: Zenith Electronics Corporation, Glenview, Ill.

[21] Appl. No.: 929,037

[22] Filed: Nov. 10, 1986

[51] Int. Cl.[4] ..... C25D 13/02

[52] U.S. Cl. ..... 204/181.1; 204/181.5; 204/181.7; 313/470; 313/472; 313/473

[58] Field of Search ..... 204/181.1, 181.5, 181.7; 350/313; 313/470, 472, 473

[56] References Cited

U.S. PATENT DOCUMENTS

| | | | |
|---|---|---|---|
| 3,314,871 | 4/1967 | Heck et al. | 204/181.1 |
| 3,360,450 | 12/1967 | Hays | 204/181.1 |
| 3,475,169 | 10/1969 | Lange | 96/1 |
| 3,554,889 | 1/1971 | Hyman et al. | 204/181.1 |
| 3,632,339 | 1/1972 | Khan | 313/472 |
| 3,681,222 | 8/1972 | Gupton | 204/181.1 |
| 3,681,223 | 8/1972 | Gupton, Jr. | 204/181 |
| 4,070,596 | 1/1978 | Tsunet et al. | 313/470 |
| 4,130,472 | 12/1978 | Kaplan et al. | 204/181 N |
| 4,617,094 | 10/1986 | Kamamori et al. | 204/181.1 |

FOREIGN PATENT DOCUMENTS

| | | | |
|---|---|---|---|
| 964713 | 3/1975 | Canada | 313/41 |
| 1242999 | 8/1971 | United Kingdom . | |

OTHER PUBLICATIONS

Sadowsky, Meier, "The Preparation of Luminescent Screens", R.C.A. Laboratories, Princeton, New Jersey, pp. 119–120.

*Primary Examiner*—John F. Niebling
*Assistant Examiner*—Ben C. Hsing

[57] ABSTRACT

An improved cataphoretic process is disclosed for use in the manufacture of a color cathode ray tube. The process provides for depositing in sequence on the tube screening surface at least two separate patterns of phosphor elements, with each pattern of elements capable of emitting light of a different color when excited. The process according to the invention comprises first depositing an electrically conductive coating over the screening surface for use as an electrode during each deposition operation. Second, an electrically insulative barrier is deposited over the conductive coating. Portions of the barrier are removed selectively and sequentially for controlling patterned, sequenced cataphoretic access to the electrically conductive coating.

14 Claims, 6 Drawing Sheets

CATAPHORETIC PROCESS FOR SCREENING COLOR CATHODE RAY TUBES

CROSS-REFERENCE TO RELATED APPLICATIONS AND PATENTS

This application is related to but in no way dependent upon copending applications Ser. No. 832,493 filed Feb. 21, 1986; Ser. No. 808,137 filed Dec. 11, 1985; Ser. No. 828,568 filed Feb. 21, 1986, and U.S. Pat. Nos. 3,457,169 and 4,130,472.

This specification includes an account of the background of the invention, a description of the best mode presently contemplated for carrying out the invention, and appended claims.

BACKGROUND OF THE INVENTION

Field of the Invention

This invention relates to color cathode ray picture tubes, and is addressed specifically to an improved cataphoretic process for manufacturing color cathode ray tubes. The process is applicable to the manufacture of conventional color picture tubes; that is, tubes having a curved faceplate and a correlatively curved shadow mask, and in the manufacture of color tubes having shadow masks of the tension foil type mounted in association with a flat or substantially flat faceplate. Color tubes of various types can be screened by the process, including those used in home entertainment television receivers. The cataphoretic process according to the invention is particularly valuable in the manufacture of medium-resolution, high-resolution, and ultra-high resolution tubes intended for color monitors. To meet the requirement for high resolution and high definition in such tubes, the phosphor elements must be extremely small and well defined. The problems inherent in screening such tubes is pointed up by the fact that there are more than five million such elements deposited on the screen of an ultra-high resolution color tube. The depositing of so many elements is at the limit of capability of conventional photoscreening processes. The cataphoretic process also offers an economical benefit in that it is much less wasteful of the expensive phosphors used in color screening.

Structure of the Color Cathode Ray Tube

The conventional process of depositing patterns of color phosphor elements on the screening surface of a color picture tube faceplate utilizes the well-known photoscreening process. A shadow mask, which in effect functions as a perforated optical stencil, is used in conjunction with a light source to expose in successive steps, three discrete light-sensitive photoresist patterns on the screening surface. The shadow mask is typically "mated" to each faceplate; that is, the same mask is used in the production of a specific tube throughout the production process, and is permanently installed in the tube in final assembly. At least four engagements and four disengagements of the mask, as well as six exposures, are required in the standard screening process. In certain processes, a "master" may be used for exposing the photoresist patterns in lieu of the mated shadow mask.

In a typical photoscreening process, the screening surface is first coated with a fluidized light-sensitive material to fabricate a grille, and which hardens upon drying. The shadow mask, mounted on a rigid frame, is temporarily installed in precise relationship to the faceplate, and the light-sensitive material is exposed to light actinic to the coating projected through the apertures of the mask from a light source located at a position that corresponds to the beam-emission point of the associated electron gun of the end-product tube. The faceplate is then separated from the shadow mask and the coating is "developed," resulting in a hardened pattern of openings in the grille. A slurry of dark surround material is coated on the faceplate and the hardened resist is stripped, leaving a light-absorbing material surrounding the areas where the phosphors are to be deposited. The red, green and blue light emitting phosphor elements are then sequentially deposited in respective grille openings with a separate slurry of phosphor in a light-sensitive material for each color. The final product is a faceplate having on its screening surface a pattern of groups of dots or lines capable of emitting, upon excitation by electron beams, red, green or blue light.

Prior Art

In U.S. Pat. No. 4,130,472 of common ownership herewith, Kaplan discloses a process for making color television screens by electrophoretic deposition. The process comprises the depositing of groups of periodically repeating electrically conductive stripes of predetermined graduated length from relatively long to relatively short on the screening surface. Both ends of stripes of similar length are electrically excited with a charge of first polarity during immersion in an electrolytic bath that includes color-image-related compounds charged to an opposite polarity. Both ends of stripes of successively shorter length are serially excited in conjunction with a different bath and a different image-related compound. By electrically contacting both ends of the stripes, the effect of a single discontinuity in the electrically conductivity of any stripes is nullified.

A process for electrostatically screening a color cathode ray tube is disclosed by Lange et al in U.S. Pat. No. 3,475,169, of common ownership herewith. In this process, the screening surface is provided with a photoconductivity layer, and a corona device scans the photoconductivity surface to establish thereon a uniform charge. A latent charge image is then created in the photoconductor by exposing selected portions to light actinic to the photoconductor. The exposure of the photoconductor takes place through a shadow mask so that areas which are to represent phosphor elements of a particular color are selectively discharged by the exposure. The latent image that results is developed by the application of a toner that includes a phosphor. The toner-phosphor responds to the electrical fields of the photoconductor and is deposited on the discharged areas. This process is repeated three times to provide the three color phosphors necessary for the cathode ray tube color image. A similar process is set forth in Patent Specification No. 1 242 999 (GB).

U.S. Pat. No. 3,681,223 to Gupton discloses means whereby color phosphors are electrophoretically deposited on a cathode ray tube screening surface to provide a dot screen. A plurality of conductive dot patterns are deposited on the faceplate, one pattern for each color to be deposited. Each pattern includes lands of material on which the dots are to be deposited, with conductive paths interconnecting the lands. The conductive patterns are deposited with a single masking operation using an interchangeable master. The different color phosphors are then successively deposited on the dot patterns by electrophoresis, one color being deposited on each discrete conductive pattern. The conductive paths are said to be one mil wide. While the blue- and green-receiving patterns are indicated as being relatively short, the conductive path for the red phosphor is relatively long—estimated to be about 900 feet in a 25-inch color picture tube. The problem of laying down a conductive path of such length with an inter-dot width of only one mil is considered to be insurmountable. A gap in the path at any point would halt electrophoresis along the uncharged path; also, variations in voltage drop along the narrow conductive stripe could result in uneven deposits of phosphor.

In Canadian Pat. No. 964,713, Standaart discloses a process for the electrophoretic deposition of color phosphors in a dot-screen pattern. A separate dot pattern with an interconnecting conductive path is provided for each color. An electrical potential is applied to an end of each path by means of a selective clamping device for the deposition of each color. The means for applying the potential are not disclosed. An interchangeable mask is used for the path deposition.

In a journal article, Sadowsky describes the preparation of luminescent screens, including deposition by electrophoresis, in which "the phosphor in liquid suspension is attracted to an immersed electrode upon which it deposits." Sadowsky comments: ". . . there is not much advantage to this method. It is uneconomical merely to apply screens in this manner, since screens of as good a quality can more easily be deposited by other means. The controls necessary on particle size, e.m.f., current, suspension, composition, temperature, etc., and the need for a conductive substrate militates against its use." ("The Preparation of Luminous Screens," Meier Sadowsky, Society for Information Display, March 1949. Pages 119–120.)

OBJECTS OF THE INVENTION

It is a general object of this invention to provide an improved process for the manufacture of color cathode ray tubes.

It is a general object of this invention to provide an improved process for depositing screening materials on the screening surface of a color cathode ray tube.

It is another general object of the invention to provide an improved process for depositing screening materials which is applicable to most types of color cathode ray tubes, including the conventional curved screen-curved faceplate tube, and the novel tube having a tensed foil shadow mask and a flat faceplate.

It is yet another object of the invention to provide a feasible and economical process for depositing screening materials on the screening surface of cathode ray tubes, using the cataphoretic process.

It is a further object of this invention to provide an improved cataphoretic process for manufacturing high-definition imaging screens.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

The process according to the invention can be used for the manufacture of various types of color cathode ray tubes including tubes having a tension foil shadow mask in conjunction with a flat faceplate, and tubes having the conventional curved screen-curved mask tubes. The operating principles of the two types are essentially the same; that is, an electron gun projects three beams through a color selection electrode to excite groups of color phosphors emitting red, green or blue light when excited by the respective electron beam.

Figure 1:
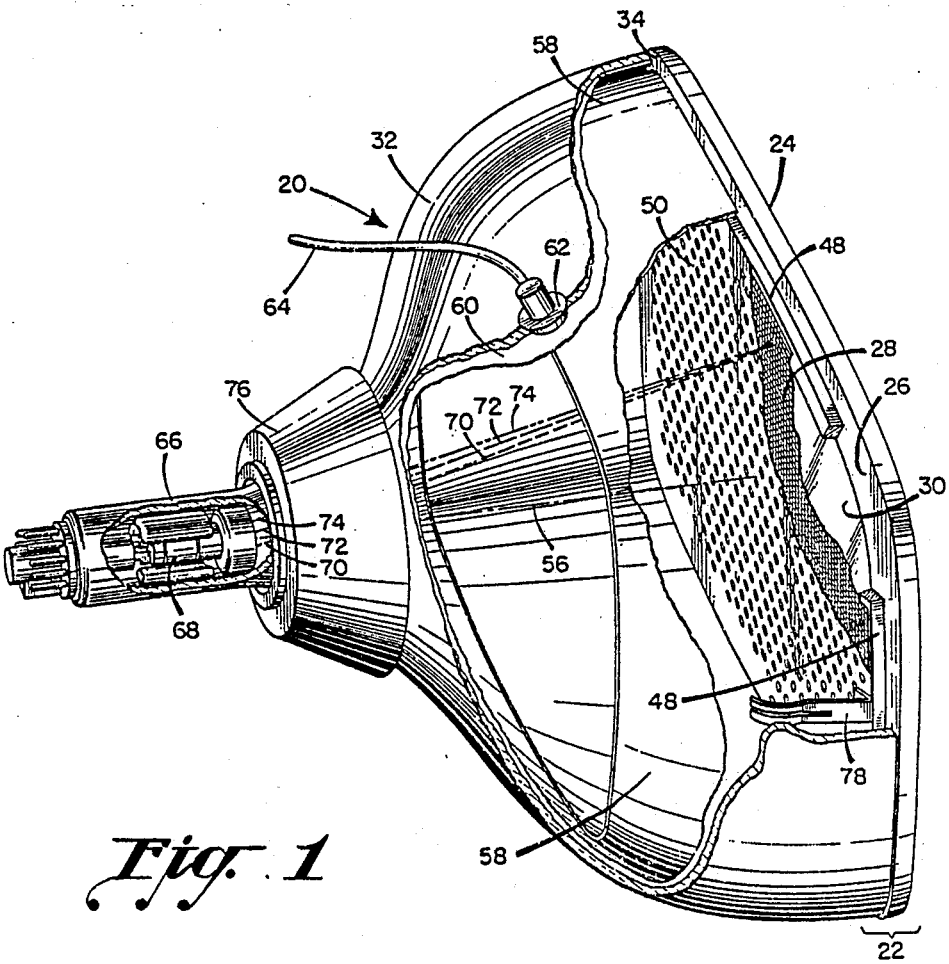
FIG. 1 is a side view in perspective of a color cathode ray tube having a flat faceplate and a tensed foil shadow mask, with cut-away sections that indicate the location and relation of the screen to other major tube components.

A color cathode ray tube 20 having a tension foil shadow mask is shown by FIG. 1. The front assembly 22 includes a faceplate 24, on the screening surface of which is deposited a phosphor screen 28. A film of aluminum 30 is indicated as covering the screen 28. A funnel 32 is shown as mating with the peripheral sealing area 34 of faceplate 24.

Front assembly 22 includes a shadow mask support structure 48 for mounting a metal foil shadow mask 50 which is secured to support structure 48 in tension. The round apertures shown in shadow mask 50 indicate that the tube is a dot-screen type. The anterior-posterior axis of tube 20 is indicated by reference number 56. A magnetic shield 58 is shown as being enclosed within funnel 32. High voltage for tube operation is applied to a conductive coating 60 on the inner surface of funnel 32 by way of an anode button 62 connected in turn to a high-voltage conductor 64.

The neck 66 of tube 20 is indicated as enclosing and in-line electron gun 68, indicated as providing three discrete in-line electron beams 70, 72 and 74 for exciting respective red-light-emitting, green-light-emitting, and blue-light-emitting phosphor elements on screen 28. The electron gun may be one of the types disclosed in referent copending applications Ser. No. 808,137 and Ser. No. 828,568. Yoke 76 receives scanning signals and provides for the scanning of beams 70, 72 and 74 across screen 28. A contact spring 78 provides an electrical path between the funnel coating 60 and the mask support structure 48.

Figure 2:
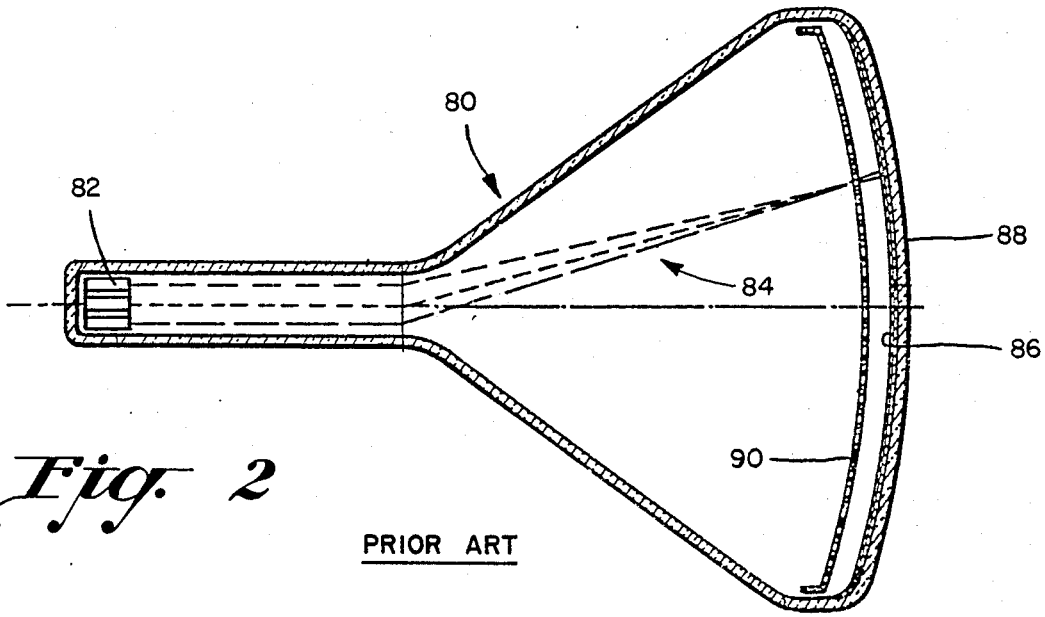
Fig. 2 PRIOR ART
FIG. 2 is a cut-away view in elevation of a color cathode ray tube having the conventional curved faceplate and curved screen.

With reference now to FIG. 2 there is shown schematically a conventional color picture tube 80. Tube 80 is similar in form and function to the tube 20 described in connection with FIG. 1 in that it has an electron gun 82 that projects three beams 84 that coverage on the phosphor-bearing screen 86 of the faceplate 88 after passing through a shadow mask 90 which, as has been noted, provides for color selection. This configuration differs however in that the faceplate 88 is curved, as indicated, and the shadow mask 90 is correlatively curved. Screen 86 may be of the dot screen or line screen type. The improved cataphoretic process according to the invention may be used to deposit image-related compounds on the screen 86 of this type of color cathode ray tube, noted as having a curved faceplate.

Figure 3:
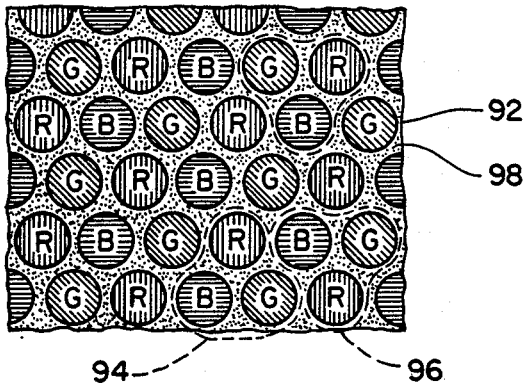
Fig. 3 PRIOR ART
FIG. 3 is a detail plan view of the screen of a color cathode ray tube having a "dot" screen.
Figure 4:
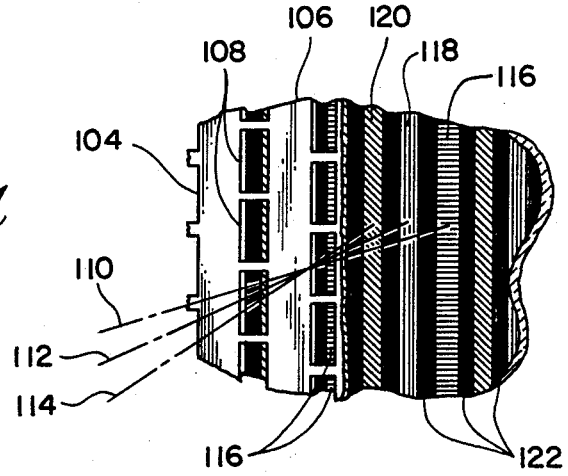
Fig. 4 PRIOR ART
FIG. 4 is a view similar to FIG. 3 except that the screen is a "line" screen shown with associated shadow mask.
Figure 5:
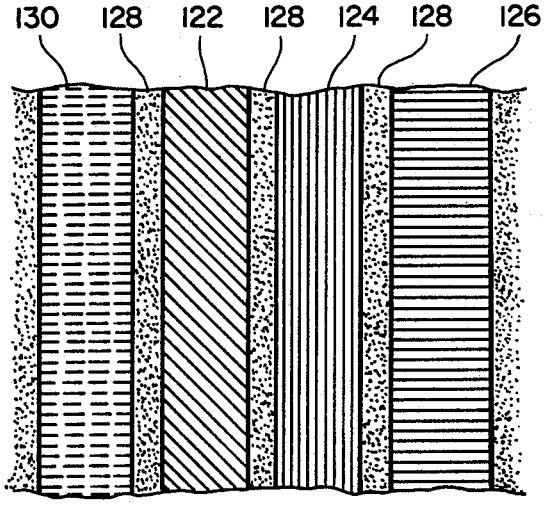
Fig. 5 PRIOR ART
FIG. 5 is another view similar to FIGS. 3 and 4 except the screen shown is the type that may be used in a beam index tube.

Types of color picture cathode ray tube screens on which can be applied image-related compounds according to the invention are depicted in FIGS. 3–5. It is noted that the process according to the invention is not limited to the examples shown as other applications will readily suggest themselves to those skilled in the art.

The improved cataphoretic process according to the invention provides for depositing in sequence on the screening surface of a color cathode ray tube at least two separate patterns of phosphor elements. FIG. 3 represents a dot screen 92 shown as having three such patterns by way of example, and comprising R, a red pattern, G, a green pattern, and B, a blue pattern, with each pattern capable of emitting light of the color designated. The three patterns—R, G, and B—are distributed throughout the screen. In a flat tension mask having a diagonal measure of 14.2 inches and a constant aperture pitch of 0.2 millimeters, there are about 1,700,000 apertures. Since each aperture passes three beamlets—one beamlet for each of the three patterns—there are about 5,100,000 phosphor elements which can be deposited on the screening surface by the cataphoretic process according to the invention. So each pattern—R, G, and B—consists of 1,700,000 phosphor elements. The patterns are grouped in triads of red, green and blue, as indicated by triad 94, delineated by the dash-line outline, and the adjacent triad 96.

Dot-pattern screen 92 is depicted as including a light-absorptive, black surround material 98 also known as the "grille"; the black surround is indicated symbolically by the stippling. The associated shadow mask (not shown in this example) generally has apertures of the same round shape, with one aperture for each triad of phosphor elements.

FIG. 4 is a depiction of a line-screen pattern 104, with the associated shadow mask 106 shown to indicate the vertically rectangular configuration of the apertures 108. The three electron beams 110, 112 and 114 are depicted as passing through a typical aperture 116 to selectively impinge upon respective blue-, red- and green-light-emitting lines of phosphor 116, 118 and 120. An opaque, light-absorptive black-surround 122 is indicated as separating the lines of phosphor.

FIG. 5 is a view similar to FIGS. 3 and 4 except that a typical screen of a beam index tube is depicted. Stripes 122, 124 and 126 are indicated symbolically as emitting green, red and blue light when excited by the horizontal traverse of a single electron beam (not shown). The stripes are depicted as being separated by a black surround material 128, as indicated by the stippling. An "index" stripe 130 may comprise, for example, an emitter of ultraviolet radiation used to "index" the system; that is, to locate the beam in relation to the phosphor stripes 122, 124 and 126 across which it passes.

These and other screen patterns not shown but which function according to the same general principles may be deposited by the cataphoretic process according to the invention.

In essence, the improved cataphoretic process according to the invention provides for the deposition in sequence on the screening surface of the tube faceplate at least two separate patterns of phosphor elements, with each pattern of elements capable of emitting light of a different color when excited. In the following description of the inventive process, first, second and third separate patterns of phosphor elements are depicted which are capable of emitting such light when excited. For exemplary purposes, the separate patterns are indicated symbolically as being red-light-emitting, green-light-emitting, and bue-light-emitting phosphor elements.

Essentially, the process according to the invention comprises first depositing an electrically conductive coating over the screening surface to serve as an electrode during each deposition operation, and secondly, depositing an electrically insulative barrier over the conductive coating and selectively and sequentially removing portions of the barrier for controlling patterned, sequenced cataphoretic access to the electrically conductive coating.

Figure 6:
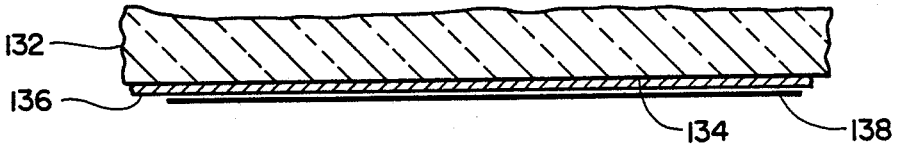
FIG. 6 is a view in elevation of a section of a flat faceplate with a dot screen, and indicating the screening area following preliminary steps in the cataphoretic process according to the invention (Note: The dot screen is used as an example in the following description of the invention)

With reference to FIG. 6, there is shown a section of a cathode ray tube faceplate 132 having a screening surface 134 on which there is indicated as being deposited an electrically conductive coating 136. Conductive coating 136 comprises metal or other electrically conductive composition. It functions as an electrode during each deposition operation. The conductive coating 136 may comprise a film of aluminum evaporated on the screening surface. The thickness of the aluminum is preferably in the range of 100 to 200 Angstrom units. In application, the screening surface 134 is first washed to remove all trace of contaminants and dried, then the aluminum is deposited by an evaporation process. The aluminum coating could as well be applied by a hot-stamping method. The aluminum coating is opaque even in the form of a very thin film, and hence must be removable so that the light emitted by the phosphors in the finished tube will not be obstructed. The thickness of the metal must therefore be carefully controlled so that the metal can be removed either by oxidation during the sealing of the tube in final assembly, or by chemically leaching it out after the last application of phosphor elements.

The conductive coating 136 could as well be transparent to visible light, and thus not require a specific removal step. An electrically conductive material with suitable transparency is indium tin oxide, which may also be applied by the evaporation process. This compound however does not have to be removed as in the case of aluminum, as is is transparent. Other types of materials which are electrically conductive and transparent, and lend themselves to application in the form of very thin films, may as well be used. Gold is an example.

With reference again to FIG. 6, an electrically insulative barrier 138 deposited over electrically conductive coating 136. Barrier 138 preferably comprises an electrically resistive photoresist layer such as a photosensitive dichromated PVA (polyvinyl alcohol) which may be applied in liquid form; e.g., by spin-application or by curtain coating. Following the application, the coating is allowed to dry.

Figure 7:
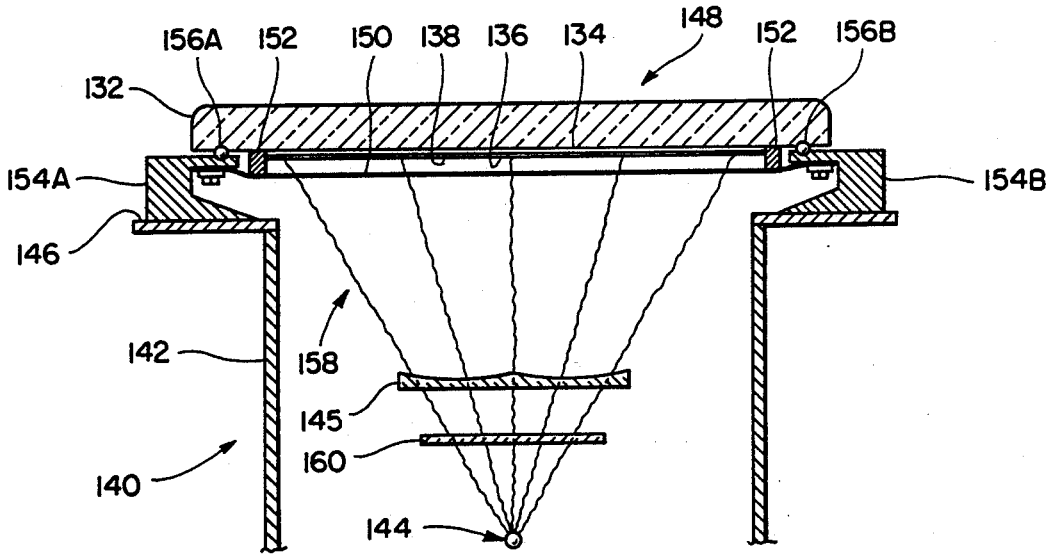
FIG. 7 is a sectional side-elevational diagrammatical view of a "lighthouse" used for exposing the screening area in the screening process according to the invention; the photoscreening of a flat tension mask faceplate assembly is indicated by way of example.

The photoresist comprising barrier 138 is then exposed through a mask to light actinic to the photoresist layer to form a fixed latent image in the layer that represents a sum pattern corresponding to the sum of aforedescribed first, second and third patterns of phosphor elements. Exposure is accomplished by means of a "lighthouse," a schematic example of which is shown by FIG. 7. Lighthouse 140 is shown as having a base 142 within which is contained a source 144 of UV (ultraviolet) light actinic to the photoresist generated by collimated light or a fine bare arc, typically an approximate point source when used for screening with shadow masks having round apertures, or a line source for masks having slit or slot apertures. The light source 144 is locatable in three positions to simulate the deflection center of each of the electron beams used to excite the phosphor elements deposited on the screening surface. This type of printing is known as "first order printing"; it requires the use of a special correction lens 145 for dot screens, to correct for a displacement of the deflection centers.

The method of photoscreening may as well by an interchangeable mask system, in which, by way of example, a separate "master" is used for printing each of the three colors and the matrix. Each master has only the apertures for the respective color; for example, the "red" master would only have apertures for printing the red phosphor deposits on the screening surface. The master is placed in contact, or near-contact, with the screening surface, and the mask is irradiated with a flood light rather than a point source of light to print the areas that are to receive the red phosphor elements. Very exact registration of the masks is a requisite for successful implementation of this system. The benefit of the interchangeable mask manufacturing system is that there is no need to permanently "pair" a mask with a specific faceplate—the screened faceplates are can be interchanged, each with all others, and the shadow masks can also be interchanged, each with all the others, with consequent economies in manufacture and enhanced tube performance.

Lighthouse 140 includes a table assembly 146 for receiving a cathode ray tube front assembly 148. Front assembly 148 will be noted as including the flat faceplate 132 described in connection with FIG. 6, with its deposits of an electrically conductive coating 136 and electrically insulative barrier 138 comprising the photoresist layer on its screening surface 134. A foil shadow mask 150 is depicted as being suspended a predetermined distance from the screening surface 134 by a shadow mask support structure 152.

Following the depositing of the electrically conductive coating and the electrically insulative barrier, the inventive process will be seen as comprising the forming of a first pattern, a second pattern, and a third pattern of holes in the insulative barrier corresponding to the sum of the first, second and third pattern of phosphor elements to be deposited on the screening surface of the tube faceplate. The first and third patterns of holes is in effect plugged with an insulative material, then a second pattern of phosphor elements is cataphoretically deposited in the second pattern of holes which are, in effect, not plugged. The first pattern of holes is then, in effect, unplugged and the first pattern of phosphor elements are cataphoretically deposited in the holes. The third pattern of holes is then, in effect, unplugged, and the third pattern of phosphor elements are deposited in the holes.

Front assembly 148 must be assembled and dis-assembled at least four times in the process of depositing the screening materials. Precision registration and re-registration of the faceplate and the shadow mask in the screening process is indicated as being provided by the support blocks 154A and 154B in conjunction with, by way of example, ball-and-groove indexing means 156A and 156B. (There are actually three sets of such ball-and-groove indexing means, only two of which are shown in this example.) Other means for precision registration known to those skilled in the art may as well be used. The light rays 158 from source 144 (sequentially located at the three deflection centers), are depicted as irradiating the screening surface 134 after passing through a neutral density filter 160 and the correction lens 145.

Figure 8:
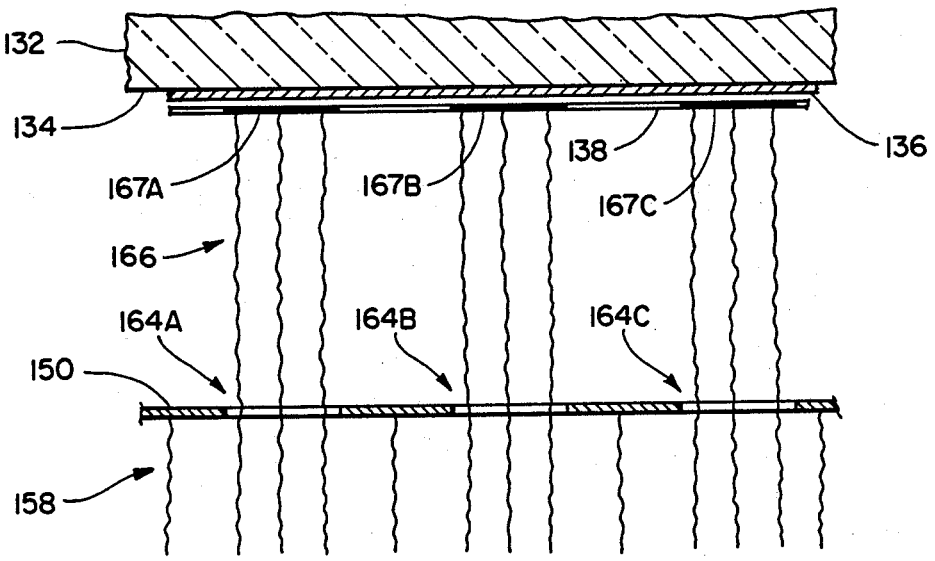
FIG. 8 a view in elevation of a section of the faceplate shown by FIG. 6, and indicating the impinging of light beamlets on selected areas of the screening surface of a dot screen during exposure of the screen to light actinic to photosensitive areas as accomplished in the lighthouse depicted in FIG. 7.

The effect of irradiating the screening surface 134 from the green, blue, and red deflection centers is shown diagrammatically by FIG. 8 (faceplate 132 is shown as a fragment and in section in this and ensuing figures). Light rays 158, indicated by the wavy lines, are depicted as passing through apertures 164A, 164B and 164C in shadow mask 150 to form beamlets 166 which impinge upon the photosensitive electrically insulative barrier 138. The effect of the light is to "fix" the areas 167A, 167B and 167C impinged upon, and form a fixed latent image in the photoresist representing a sum pattern corresponding to the sum of the first, second and third patterns of phosphor elements; that is, all areas on which the three colored-light-emitting phosphors are to be deposited are formed as latent images.

Figure 9:
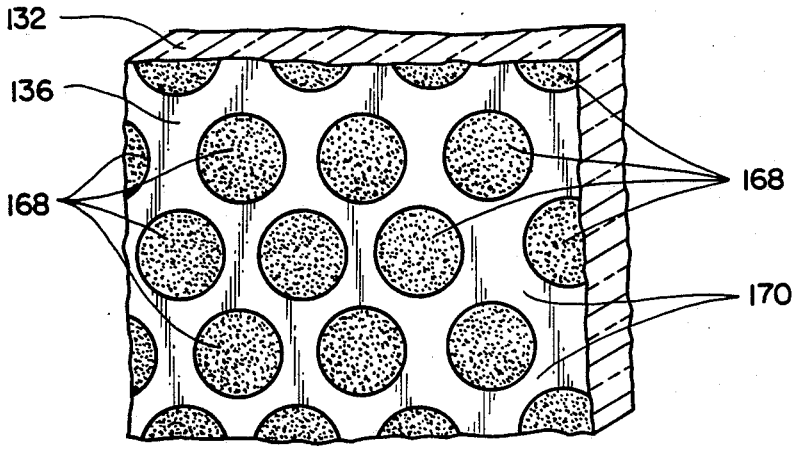
FIG. 9 is a plan view of a section of a dot screen faceplate following the exposure step indicated by FIG. 8.

The screening surface is then "developed"; that is, the unfixed photoresist layer that surrounds each of the patterns is removed by spraying with water, for example. The hardened, or "fixed," patterns are not affected by the water spray. The result is depicted in FIG. 9 wherein there remains on the the electrically conductive coating 136 of faceplate 132 a fixed-resist-covered sum pattern of discrete, electrically insulative photoresist elements 168 surrounded by bared areas 170 of the electrically conductive coating 136.

The means for photoprinting the screen is described in the foregoing as being accomplished using a shadow mask as a stencil, and sequentially locating the actinic light source at the three deflection centers of the "red, green and blue" guns. In this system, is it necessary to pair the masks and faceplates, and maintain the parity throughout the manufacturing and assembly processes. As noted heretobefore, screening can as well be accomplished by an interchangeable mask system, as has been described.

Figure 10:
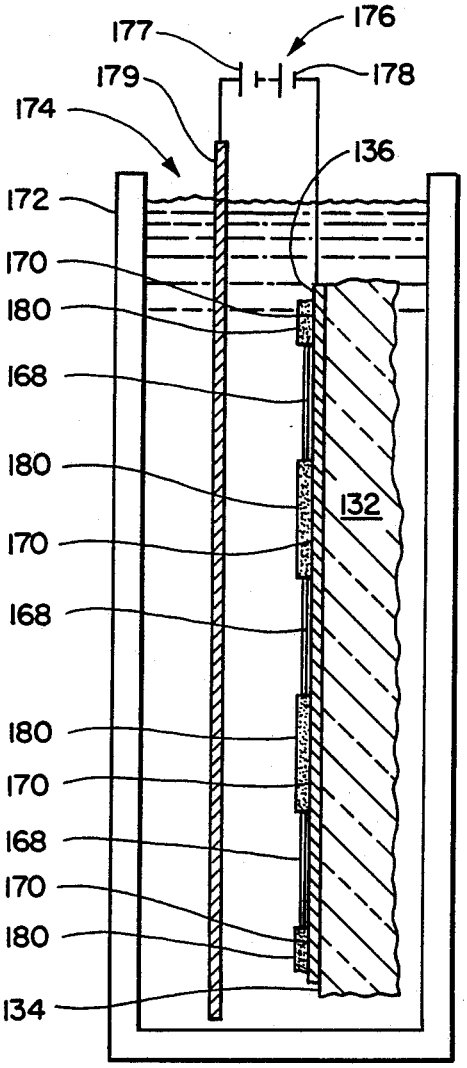
FIG. 10 is a schematic view in elevation of a bath used in the cataphoretic screening process according to the invention, and containing a section of the faceplate shown by FIG. 9 as immersed in the bath.
Figure 14:
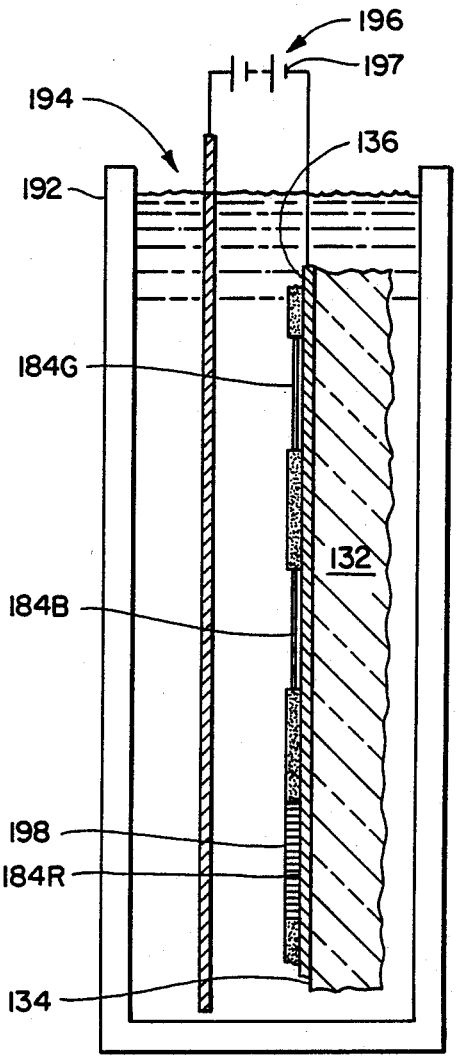
FIG. 14 is a view of a cataphoretic bath similar to the bath of FIG. 10, but showing a further step in the process according to the invention.

With reference now to FIG. 10, there is represented schematically a cataphoretic bath 172 for the depositing of the screening materials according to the invention. The faceplate 132 is indicated diagrammatically as being immersed in vertical orientation in cataphoretic bath 172. Bath 172 contains an electrolytic fluid 174 which may include, by way of example, a light-absorptive, black-surround material which is preferably nonconductive. This material may comprise manganese carbonate by way of example, which when deposited by cataphoresis is light in color, but turns black and opaque as it oxidizes during the bake-out of the tube in final assembly. Other suitable black-surround materials include cobalt oxide black, and iron oxides with cobalt oxides.

An electrical potential is depicted as being applied between the electrically conductive coating 136 and an anode 179, with the potential depicted schematically as being applied by a battery 176. The negative electrode 178 of battery 176 is indicated as being electrically connected to the conductive coating 136. The positive electrode 177 is indicated as being electrically connected to the anode electrode 179 which may comprise, by way of example, a sheet of stainless steel preferably having approximately the same area as the in-process faceplate. The difference in potential may be for example about 100 volts, and the duration of the cataphoretic process about one minute. The difference in potential results in the cataphoretic deposition on the bared areas 170 of the electrically conductive coating 136, a coating of electrically insulative, interstitial material. This deposition is indicated by the build-up 180 of electrically insulative material in hitherto bared areas 170, depicted diagrammatically by the stippling. As noted, the electrically insulative photoresist elements prevent cataphoretic deposition on areas covered.

Figure 11:
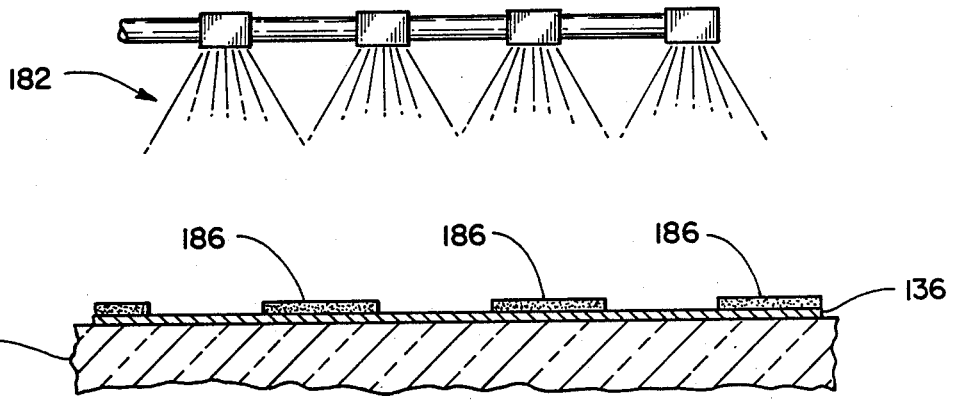
FIG. 11 is a view in elevation of the section of faceplate shown by FIG. 9, with a wash-off spray operation indicated diagrammatically.

With reference now to FIG. 11, faceplate 132 is indicated as having been removed from the cataphoretic bath 172 and subjected to a spray wash 182. The composition of the wash depends upon the type of photoresist; for example, the wash may be hydrogen peroxide in a 10 percent concentration. The wash results in a removal of the fixed photoresist sum pattern of discrete photoresist elements to bare areas of the conductive coating corresponding to the sum pattern. These areas are surrounded by the interstitial, electrically insulative material 186 represented by the stippling. In brief, the photoresist elements 168 (see FIG. 10), noted as comprising PVA, are washed off the electrically conductive coating 136, leaving a bare metal conductor. To bare the areas, a water wash is applied; the washing operation is indicated diagramatically by the spray apparatus 182; however, it is noted that a wash gentler than a spray is recommended in all washing operations, such as a very low-velocity curtain wash.

Figure 12:
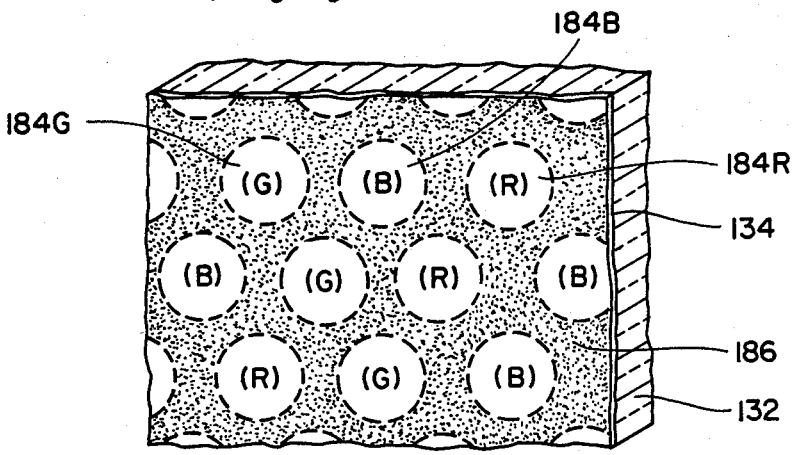
FIG. 12 is a plan view of the section of the faceplate shown by FIG. 9, showing the results of previous steps in the cataphoretic process according to the invention.

The result is shown by FIG. 12, wherein the screening surface 134 of faceplate 132 is depicted as having bare areas 184G (representing the first pattern), 184B (representing the second pattern) and 184R (representing the third pattern); the suffixes G, B and R indicate the color emission of the phosphors that will subsequently be deposited thereon. (NOTE: pattern 184G, 184B and 184R, although not in the form of a triad, comprise, for purposes of example, a typical group of phosphors representing all groups that will eventually be deposited on the screening surface; that is, a first, second and third pattern of holes, or bare areas, corresponding to the separate patterns of phosphor elements to be applied. The bare areas will be observed as being surrounded by interstitial material 186, as indicated by the stippling.

Following each cataphoretic bath, the cataphoretic deposits are rinsed with a suitable wash such as isopropyl alcohol or methanol; this step is necessary to remove loose particles in the bath which may have adhered to the screening surface. The coatings are then dried before subsequent processing. If the coatings require additional binder to withstand further processing steps, suitable binder may be applied in the form of an overcoat, or the binder may be incorporated in the respective baths.

Figure 13:
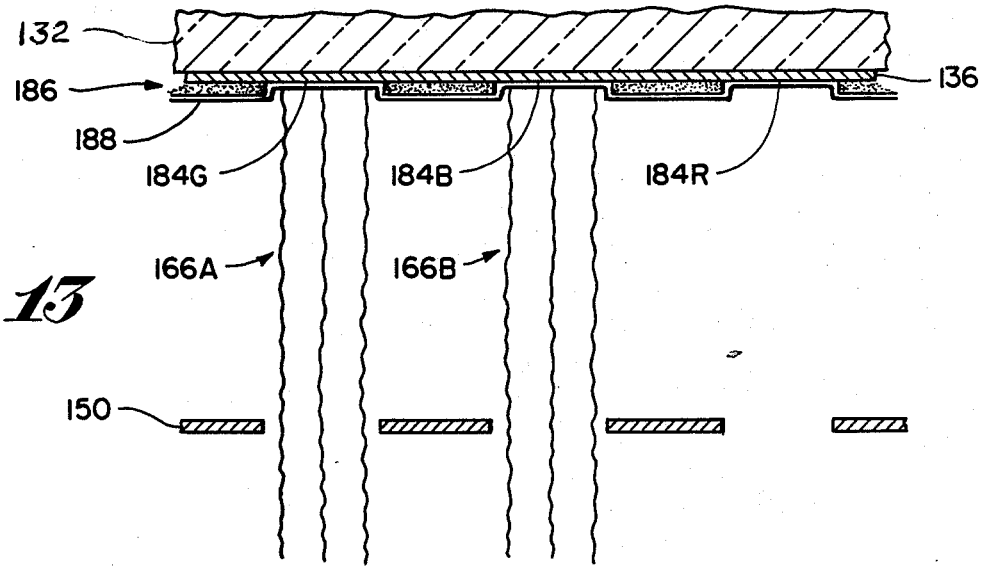
FIG. 13 is a view similar to FIG. 8 showing the selective impinging of light beamlets on the screening surface in another step in the process according to the invention.

Another layer of insulative photoresist is applied to the screening surface to form an electrically insulative barrier. With reference to FIG. 13, there is shown an electrically insulative barrier 188 depicted as overlaying the interstitial material 186, noted as being indicated by the stippling, and the previously bared areas 184R, 184B and 184G. This barrier may comprise PVA-AD. The photoresist layer 188 is then exposed through mask 150 to light actinic to the photoresist. The light beamlet 166A originates from the blue deflection center, and secondly, light beamlet 166G originates at the green deflection center; it will be noted that no light is irradiating area 184R, so that red deflection center is inactive. As a result, the photoresist is fixed in areas 184G and 184B. Since no light originates from the red deflection center, the photoresist layer 188 over area 184R remains unfixed.

The unfixed photoresist over area 184R is then removed to bare electrically conductive areas in a pattern corresponding to the first pattern represented by area 184R. As a result, a second and third pattern of fixed photoresist elements is formed, represented by 184G and 184B. To bare area 184R, a water wash is applied; as noted heretobefore, a very low-velocity curtain wash is recommended.

While using the conductive coating 136 again as an electrode, a first phosphor, which is red-light-emitting by way of example, is cataphoretically deposited on the bared areas of the electrically conductive coating 136. This step is depicted in FIG. 4 wherein there is represented schematically a cataphoretic bath 192 into which faceplate 132 is inserted, and which contains an electrolytic fluid 194 which includes in suspension a red-light-emitting phosphor compound. An electrical potential is indicated as being applied between the electrically conductive coating 136 and electrolytic fluid 194, with the potential depicted schematically as being applied by a battery 196 in which the negative electrode 197 is shown as being connected to the electrically conductive coating 136. The difference in potential may be for example about 200 volts, and the duration of the cataphoretic process about one minute, by way of example. The difference in potential results in the cataphoretic deposition on the bared area 184R of the electrically conductive coating 136, of a coating of phosphor 198, indicated diagrammatically as being a red-light-emitting phosphor. Phosphor 198 is deposited to a predetermined thickness which forms, after drying, a substantial electrical barrier that prevents further cataphoresis. The thickness of the phosphor is preferably in the range of 10–20 microns. During the deposition process, the phosphor builds up rapidly at first; the build-up then becomes progressively slower with increasing thickness. At the end of the deposition period, the phosphor is sufficiently thick and thus electrically resistive enough to prevent subsequent deposition of phosphor.

Figure 15:
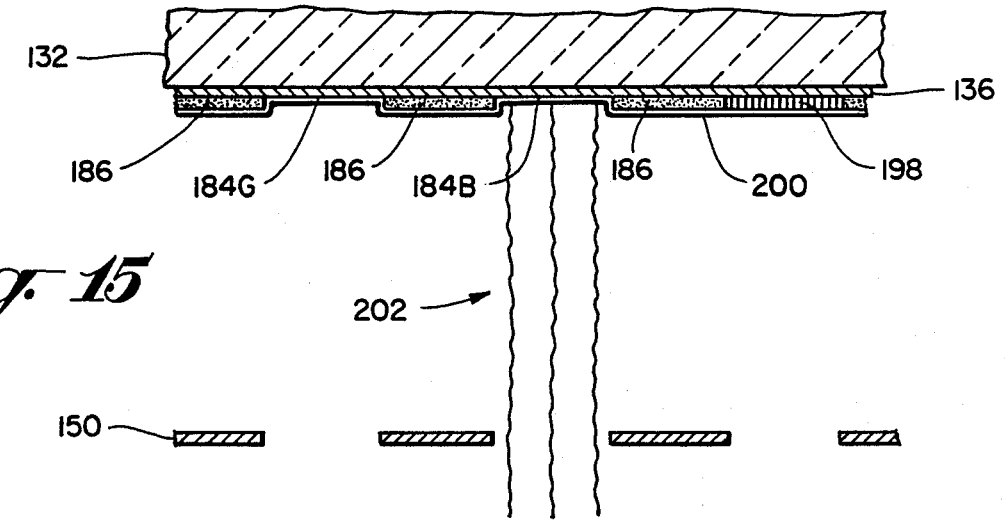
FIG. 15 depicts another step in the selective impinging of light beamlets on the screening surface.

The electrically insulating barrier in areas 184B and 184G, noted as comprising PVA-AD in a fixed state, is then removed to bare electrical conductive areas 184B and 184G by stripping with a 10 percent solution of hydrogen peroxide. Another layer of electrically insulative photoresist is then applied to form an electrically insulative barrier comprising a photosensitive photoresist. This condition is shown by FIG. 15, in which an electrically resistive barrier 200 is depicted as overlying the entire screening area, including phosphor element 198.

The photoresist layer is then exposed to light actinic to the photoresist to form a fixed latent image in area 184B. The light rays emanate from the blue deflection center to form, upon passing through shadow mask 150, light beamlet 202. It will be noted that area 184G is not being irradiated. The unfixed photoresist is then removed to bare the electrically conductive layer 136 in area 184G, which is to receive a deposition of green-light-emitting phosphor. It will be noted that the unfixed photoresist is removed from all areas except area 184B, including the areas of the interstitial material 186 and including phosphor element 198. Removal of the unfixed photoresist is accomplished by a gentle flow of water.

Figure 16:
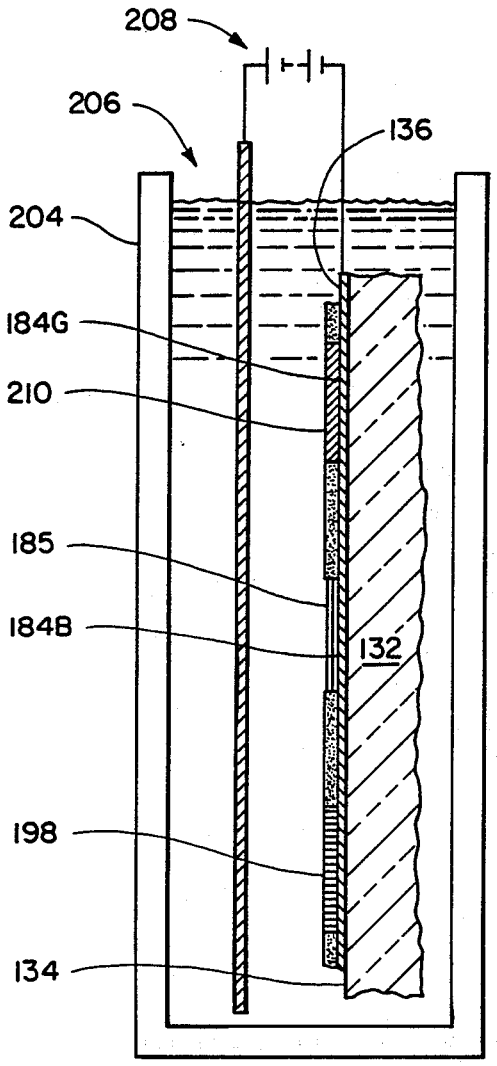
FIGS. 16 and 17 are views of cataphoretic baths similar to the bath of FIG. 10, and depicting further steps in the process according to the invention.

With reference to FIG. 16, the cataphoretic process is repeated, again using the conductive coating 136 as an electrode. It will be observed that, as a result of the previous step, only area 184B is covered with an electrically resistive barrier, barrier 185. A cataphoretic bath 204 is depicted into which faceplate 132 is immersed. At this time, a green-light-emitting phosphor is deposited as the electrolytic fluid 206 contained in bath 204 comprises a suspension of green-light-emitting phosphor particles. As before, and as indicated schematically by battery 208, an electrical potential is provided between the electrolytic fluid 206 and the conductive coating 136. As a result, a green-light-emitting phosphor element 210, indicated symbolically, is indicated as being deposited in area 184G. The difference in potential may be for example about 200 volts, and the duration of the cataphoretic process about 1.0 minutes, by way of example. The difference in potential results in the cataphoretic depositing on the bared area 184G of the electrically conductive coating 136, a coating of phosphor 210. As with the red-light-emitting phosphor 198 previously deposited, green-light-emitting phosphor element 210 is deposited to a predetermined thickness which forms a substantial barrier to further cataphoresis. As has been noted, the thickness of the phosphor is preferably in the range of 10–20 microns.

Figure 17:
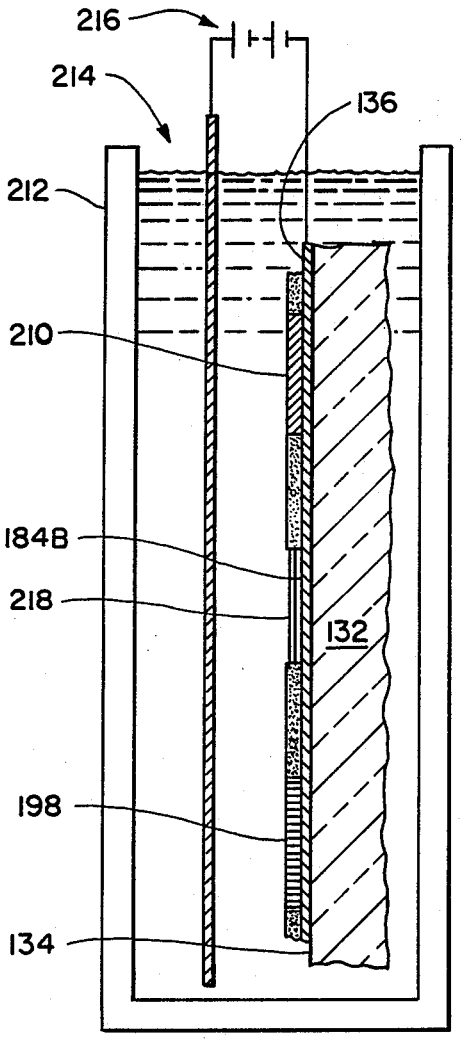

The final depositing of phosphor elements is the deposition of the blue-light-emitting elements. No further photoscreening is required as the electrically resistive barrier 185 overlying area 184B need only be removed to bare the underlying electrically conductive coating 136. As before, the means of removal is a gentle wash with as 10 percent solution of hydrogen peroxide. The final cataphoretic step is depicted in FIG. 17, in which a cataphoretic bath 212 contains an electrolytic fluid 214 that comprises a suspension of blue-light-emitting phosphor particles. The difference in electrical potential induced by the circuit of battery 216 cataphoretically causes deposition of a blue-light-emitting phosphor deposit 218 in areas 184B. As noted, the red-light-emitting phosphor element 198 and green-light-emitting phosphor element 210 form a substantial electrical barrier to further cataphoresis in the respective areas 184R and 184G.

If the underlying conductive coating is a film of aluminum, noted as being not transparent, the coating may be removed by chemically stripping it away to prevent obstruction of the light emitted by the phosphors thereon deposited. Experiments have shown that the adherence of the phosphor elements to the glass of the faceplate is not affected by the removal of the underlying conductive coating.

Following the cataphoretic deposition process according to the invention, the screening surface may be aluminized by any of the well-known processes.

In the cataphoretic process according to the invention, the use of standard, material-type phosphors is acceptable. The median diameter of the particles of the phosphors that emit red, green and blue light is about six microns. The phosphor concentration in the baths is about two grams per 100 milliliters. The bath medium recommended is 75 percent isopropyl alcohol (Reagent grade, 0.2% water), and 25% methyl carbitol. The electrolyte concentration is 0.04 grams lanthanum nitrate plus 0.02 grams aluminum nitrate plus 0.2 milliliters of deionized water per 100 milliliters of suspension. The density of the phosphors when deposited is typically about 2.5 milligrams per square centimeter.

With regard to the composition of the grille, manganese carbonate may be used, by way of example, with the particles having a median diameter of one to two microns. Concentration of the grille bath is 1 gram per 100 milliliters by way of example, and the liquid medium is the same as for the phosphors. The electrolyte component is 0.03 grams lanthanum nitrate plus 0.015 grams of aluminum nitrate plus 0.15 milliliters of deionized water per 100 milliliters of suspension.

The voltage for cataphoresis is preferably in the range of 100 to 200. The current for grille coating at 100 volts is about $0.3\times10^{-3}$ amperes per square centimeter, and for the phosphors, 2 or $3\times10^{-3}$ amperes per square centimeter. The specific resistance of the baths is in the range of $1.7\times10^{5}$ ohms per centimeter to $1.0\times10^{5}$ ohms per centimeter. The anode electrode may for example be stainless steel of about the same dimensions as the faceplate to be screened. The anode electrode is suspended in the bath evenly spaced from the faceplate being processed by about 2.5 inch. It is to be noted that these and other values cited in this disclosure are not limiting, but are supplied for exemplary purposes only.

It will be recognized that changes may be made in the process according to the invention, and in the order of the steps described, without departing from the true spirit and scope of the invention herein involved, and it is intended that the description of the inventive process shall be interpreted as illustrative and not in a limiting sense.

What is claimed is:

1. For use in the manufacture of a color cathode ray tube, an improved cataphoretic process for depositing in sequence on the screening surface of the tube faceplate at least two separate patterns of substantially round phosphor elements, with each pattern of elements capable of emitting light of a different color when excited, the process comprising first depositing an electrically conductive coating over said screening surface for use as an electrode during each deposition operation, and secondly, depositing an electrically insulative barrier over said conductive coating and selectively and sequentially removing portions of said barrier for controlling patterned, sequenced cataphoretic access to said electrically conductive coating.

2. The process according to claim 1 wherein said conductive coating is opaque but removable, or is transparent to visible light.

3. The process according to claim 1 wherein said insulative layer includes a light-absorptive, black-surround material.

4. For use in the manufacture of a color cathode ray tube, an improved cataphoretic process for depositing on a screening surface of the tube faceplate first and second separate patterns of phosphor elements, with each pattern of phosphor elements being capable of emitting light of a different color when excited, the process comprising:

depositing an electrically conductive coating over said screening surface, and shielding said electrically conductive coating with an electrically insulative barrier;

forming a first pattern and a second pattern of holes in said insulative barrier corresponding to the sum of said first and second separate patterns of phosphor elements;

in effect, plugging the first pattern of holes with an insulative material, and then cataphoretically depositing said second pattern of phosphor elements in said second pattern of holes; and in effect, unplugging said first pattern of holes and cataphoretically depositing said first pattern of phosphor elements therein.

5. For use in the manufacture of a color cathode ray tube, an improved cataphoretic process for depositing on an screening surface of the tube faceplate first, second and third separate patterns of phosphor elements, with each pattern of phosphor elements capable of emitting light of a different color when excited, the process comprising:

depositing an electrically conductive coating over said screening surface, and shielding said electrically conductive coating with an electrically insulative barrier;

forming a first pattern, a second pattern, and a third pattern of holes in said insulative barrier corresponding to the sum of said first, second and third separate patterns of phosphor elements;

in effect, plugging the first and third pattern of holes with an insulative material and then cataphoretically depositing said second pattern of phosphor elements in said second pattern of holes;

in effect, unplugging said first pattern of holes and then cataphoretically depositing said first pattern of phosphor elements in said holes; and in effect, unplugging said third pattern of holes and cataphoretically depositing said third pattern of phosphor elements in said holes.

6. For use in the manufacture of a color cathode ray tube having a faceplate with a screening surface, an improved cataphoretic process for depositing on said screening surface first and second separate patterns of phosphor elements interspaced by a light-absorptive, black surround material, with each pattern of phosphor elements capable of emitting light of a different color when excited, the process comprising:

depositing an electrically conductive aluminum coating over said screening surface, and shielding said electrically conductive coating with an electrically insulative barrier;

forming a first pattern and a second pattern of holes in said insulative barrier corresponding to the sum of said first and second separate patterns of phosphor elements;

in effect, plugging the first pattern of holes with an insulative material, and then cataphoretically depositing said second pattern of phosphor elements in said second pattern of holes;

in effect, unplugging said first pattern of holes and cataphoretically depositing said first pattern of phosphor elements in said holes; and removing said aluminum coating.

7. For use in the manufacture of a color cathode ray tube, an improved cataphoretic process for depositing on the screening surface of the tube faceplate at least two separate patterns of substantially round phosphor elements, with each pattern of elements capable of emitting light of a different color when excited, the process comprising:

depositing an electrically conductive coating over said screening surface, and shielding said electrically conductive coating with an electrically insulative barrier;

causing to be formed in said barrier in sequence and mutually exclusive in time at least two patterns of coating-baring openings corresponding to said patterns of phosphor elements, each pattern formation being following by a cataphoretic deposition of one of said patterns of phosphor elements on the bared areas of said conductive coating using said conductive coating as an electrode.

8. For use in the manufacture of a color cathode ray tube, an improved cataphoretic process for depositing on the screening surface of the tube faceplate first, second and third separate patterns of substantially round phosphor elements, with each pattern of elements capable of emitting light of a different color when excited, the process comprising:

depositing an electrically conductive aluminum coating over said screening surface and shielding said electrically conductive coating with an electrically insulative barrier which includes a light-absorptive, black surround material;

causing to be formed in said barrier in sequence and mutually exclusive in time first, second and third patterns of coating-baring openings corresponding to said first, second and and third patterns of phosphor elements, each pattern formation being following by a cataphoretic deposition of one of said patterns of phosphor elements on the bared areas of said conductive coating using said conductive coating as an electrode; and removing said aluminum coating.

9. For use in the manufacture of a color cathode ray tube, an improved cataphoretic process for depositing on the screening surface of the tube faceplate at least two separate patterns of substantially round phosphor elements with each pattern of elements capable of emitting light of a different color when excited, the process comprising:

depositing a transparent electrically conductive coating over said screening surface and shielding said electrically conductive coating with an electrically insulative barrier;

causing to be formed in said barrier in sequence and mutually exclusive in time at least two patterns of coating-baring openings corresponding to said patterns of phosphor elements, each pattern formation being following by a cataphoretic deposition of one of said patterns of phosphor elements on the bared areas of said conductive coating using said conductive coating as an electrode.

10. For use in the manufacture of a color cathode ray tube, an improved cataphoretic process for depositing on the screening surface of the tube faceplate first, second and third separate patterns of substantially round phosphor elements with each pattern of elements capable of emitting light of a different color when excited, the process comprising:

depositing an electrically conductive coating over said screening surface and protecting said electrically conductive coating with an electrically insulative barrier wherein said barrier includes a light-absorptive, black surround material;

causing to be formed in said barrier in sequence and mutually exclusive in time first, second and third patterns of coating-baring openings corresponding to said first, second and third patterns of phosphor elements, each pattern formation being following by a cataphoretic deposition of one of said patterns of phosphor elements on the bared areas of said conductive coating using said conductive coating as an electrode.

11. The improved cataphoretic process according to claim 10 wherein said conductive coating is an aluminum film which is removed following said process.

12. For use in the manufacture of a color cathode ray tube, an improved cataphoretic process for depositing on the screening surface of the tube faceplate at least first and second separate patterns of phosphor elements emitting light of different colors, respectively, and an interstitial pattern occupying interstices between said first and second patterns, the process comprising:

depositing on said screening surface an electrically conductive coating;

applying a first layer of electrically insulative photoresist over said electrically conductive coating to form an electrically insulative barrier;

exposing said photoresist layer through a mask to light actinic to said photoresist to form a fixed latent image in said photoresist layer representing a sum pattern corresponding to the sum of said first and second patterns;

removing unfixed areas of said photoresist layer, leaving a fixed-resist-covered sum pattern of discrete, electrically insulative photoresist elements surrounded by bared areas of the electrically conductive coating;

while using said conductive coating as an electrode, cataphoretically depositing of the bared areas of said electrically conductive coating a layer of electrically insulative, interstitial material;

removing the fixed photoresist sum pattern of discrete photoresist elements to bare areas of the conductive coating corresponding to said sum pattern surrounded by said interstitial, electrically insulative material;

applying another layer of electrically insulative photoresist to form an electrically insulative barrier;

exposing said photoresist layer to light actinic to said photoresist through a mask having a pattern of openings corresponding to said first pattern, said mask blocking light corresponding to said second pattern to form a fixed latent image in said photoresist layer of said first pattern;

removing unfixed photoresist to bare electrically conductive areas in a pattern corresponding to said second pattern, thereby forming a first pattern of fixed photoresist elements;

while using the conductive coating again as an electrode, cataphoretically depositing a first phosphor on the bared areas of said electrically conductive coating to a predetermined thickness at which is formed a substantial electrical barrier to further cataphoresis of the first phosphor;

removing the first pattern of fixed photoresist elements;

using the conductive coating again as electrode, cataphoretically depositing a second phosphor on the bared areas of the conductive coating in a pattern corresponding to said first pattern.

13. The process according to claim 12 wherein said conductive coating is a film of aluminum.

14. The process according to claim 12 wherein said film of aluminum is removed following completion of said cataphoretic process.

* * * * *